United States Patent [19]

Pettersson

[11] Patent Number: 4,941,945

[45] Date of Patent: Jul. 17, 1990

[54] METHOD FOR CLARIFYING GREEN LIQUOR

[75] Inventor: Bertil Pettersson, Gävle, Sweden

[73] Assignee: Hedemora AB, Hedemora, Sweden

[21] Appl. No.: 259,570

[22] PCT Filed: Feb. 3, 1988

[86] PCT No.: PCT/SE88/00035

§ 371 Date: Oct. 12, 1988

§ 102(e) Date: Oct. 12, 1988

[87] PCT Pub. No.: WO88/06203

PCT Pub. Date: Aug. 25, 1988

[30] Foreign Application Priority Data

Feb. 12, 1987 [SE] Sweden ..... 8709549

[51] Int. Cl.[5] ..... D21C 11/04

[52] U.S. Cl. ..... 162/29; 162/30.1; 162/30.11; 423/183; 423/DIG. 3

[58] Field of Search ..... 162/29, 30.1, 30.11; 423/DIG. 3, 183, 182

[56] References Cited

U.S. PATENT DOCUMENTS

| | | | |
|---|---|---|---|
| 1,815,646 | 7/1931 | Bates et al. | 162/30.1 |
| 2,552,183 | 5/1951 | Knight | 162/30.11 |
| 2,734,037 | 7/1951 | Mannbro | 162/30.1 |
| 4,302,281 | 11/1981 | Ryham | 162/30.11 |
| 4,770,742 | 9/1988 | Bonsu | 162/29 |

FOREIGN PATENT DOCUMENTS

| | | | |
|---|---|---|---|
| 61-174491 | 8/1986 | Japan | 162/29 |
| WO85/01966 | 5/1985 | PCT Int'l Appl. | 162/29 |

*Primary Examiner*—Steve Alvo

*Attorney, Agent, or Firm*—Pollock, Vande Sande & Priddy

[57] ABSTRACT

A method of cleaning green liquor of solid particulate impurities by adding caustic lime corresponding to 0.5 to 10% of the amount of caustic lime needed for complete causticizing of the green liquor to the green liquor in a soda dissolving tank or in a separate mixing tank to which the liquor is led directly from the dissolving tank. Calcium carbonate precipitates and forms, with the impurities, particles having better settling and filtration properties than particles in green liquor which has not been treated with caustic lime.

8 Claims, 1 Drawing Sheet

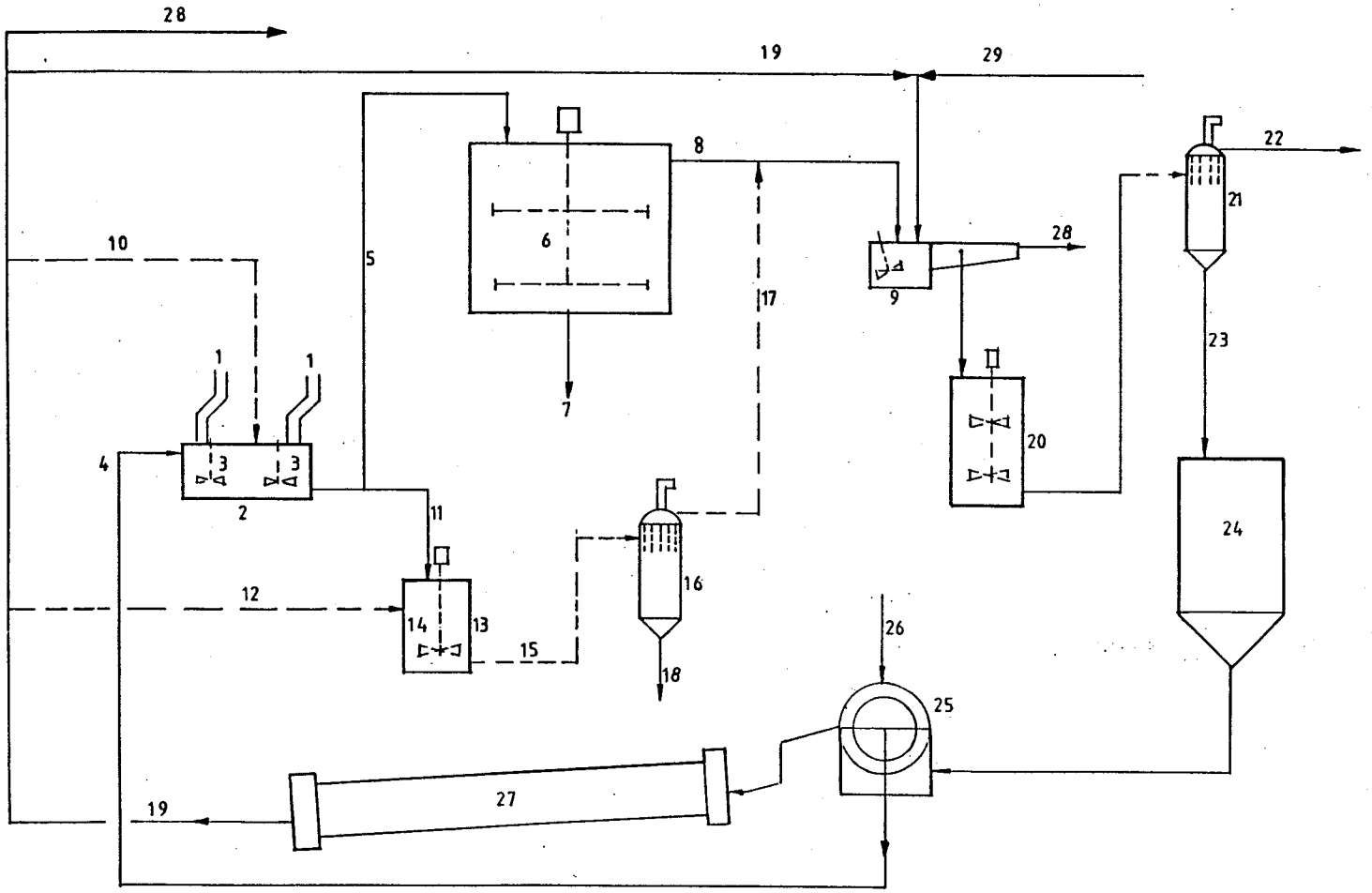
1
1
2
3
3
4
5
6
7
8
9
10
11
12
13
14
15
16
17
18
19
19
20
21
22
23
24
25
26
27
28
28
29

METHOD FOR CLARIFYING GREEN LIQUOR

TECHNICAL FIELD

The present invention relates to a process for improving the settling and filtration properties of green liquor so that the cleaning of green liquor from impurities by settling in green liquor clarifiers can be carried out faster than up to now, or by filtration, which has not been possible up to now. As another result of the process the decrease in the degree of reduction, that goes on during the process of causticizing the green liquor to white liquor, can be considerably lowered, i.e. the degree of reduction of the white liquor leaving the process will be greater than has been normal up to now.

BACKGROUND ART

On digestion of wood or other vegetable material in order to produce pulp (e.g. paper pulp) according to the sulphate method the pulping chemicals are recovered in the following way:

The waste liquor obtained during the digestion of wood, the black liquor, is evaporated to give concentrated waste liquor, thick waste liquor, that is burnt in a soda recovery boiler. A smelt is obtained that is led in smelt spouts down in a tank where it is dissolved in weak liquor obtained by the washing of lime sludge in the causticizing department. Green liquor is then obtained. It is led to a green liquor clarifier for the removal of solid particles by sedimentation. The clarified green liquor is led to a lime-slaker where caustic lime (calcium oxide) is fed to it. The calcium oxide will react with the sodium carbonate in the green liquor and a solution of sodium hydroxide and a precipitate of calcium carbonate, lime sludge or mud, as it is called, is formed. The lime sludge is separated by filtration from the white liquor obtained by the reaction (causticizing). The lime sludge is washed with hot water in order to take care of soluble alkaline chemical compounds. The weak liquor from this process is led to the above mentioned tank for dissolution of the smelt. The lime sludge is reburnt in a rotating lime kiln to give caustic lime that is brought back to the lime-slaker for causticizing of the green liquor.

In order to avoid an increase of the concentration of inert compounds in the white liquor and in the lime-cycle, it is necessary to draw off a small quantity of caustic lime or lime sludge. The amount of lime or lime sludge that must be extracted from the process system is partly dependent on how well the clarifying of the green liquor works and is normally 3–6% of the charged amount of caustic lime, i.e. 7.5–15 kg per metric ton pulp.

The smelt obtained in the soda recovery boiler contains besides the sodium- and sulphur-compounds necessary for the digestion process also small amounts of inorganic, sparingly soluble compounds of silicon and aluminum, which are incrustation forming and hence have to be removed from the process, and also variable amounts of carbon particles (soot) which are considered as rendering the cleaning of the green liquor more difficult. These impurities follow the green liquor as more or less fine particles. They are very difficult to separate and have up to now only been able to be removed by settling in so called green liquor clarifiers and then only with very low surface load, for example, about 0.5 m/h. The result of the cleaning varies normally very much and the concentration of the remaining impurities in the green liquor is normally not below 50 mg/l.

As very large volumes of green liquor must be cleaned, i.e., about 3.5 $m^3$ per metric ton pulp, very large clarifiers are required in order to give acceptable cleaning. It has consequently been a object desired to be able to remove the impurities on conventional filters as exemplified by press filters, vacuum filters, disc filters, and drum filters, partly in order to decrease the space needed and the investment costs and partly in order to improve the cleaning of the green liquor. This has, however, not been possible because the impurities cause large pressure drops in conventional filters and consequently a very low capacity.

Attempts to filter the green liquor have, however, been performed. For example, in the Swedish patent application 8103333-4 a process is described according to which lime sludge is laid as a filtering layer on a press filter before starting the filtration of the green liquor. The practical effect of this method of apporach depends among other things on how much of the impurities in the green liquor the filtering layer can take up before it is filled up and must be replaced with a new layer. This procedure has not yet been applied commercially.

SUMMARY OF INVENTION

The present invention shows a way to treat green liquor so that its impurities will have better settling and filtering properties.

As a result of the present invention, better cleaning of the green liquor than hitherto is made possible and, as a consequence, a considerable decrease of the loss of degree of reduction in the green liquor during the causticizing process can be achieved. (The degree of reduction is defined as the content of $HS^-$ as a percentage of the total content of sulphur in the liquor.) An explanation as to why the degree of reduction is decreased less when the invention is applied can be that substances which catalyze the oxidation of sulphide are removed by the more efficient cleaning.

To the unclarified green liquor a small quantity of caustic lime is charged, i.e., 0.5–10%, and preferably 1–3% of the quantity of lime necessary for complete causticizing. A quantity of 1–3% corresponds to 2.5–7.5 kg per metric ton pulp, but at most a quantity equal to the quantity necessary to draw off in order to avoid an increase of the content of inert compounds. This charge of caustic lime increases the settling velocity of the particles in the green liquor and consequently, when conventional green liquor clarifiers are used, the surface load can be increased. This change also improves the green liquor filterability and, hence, the cleaning can with advantage be performed in conventional types of filters, such as press filters, vacuum filters, disc filters and drum filters, which was not earlier possible.

An explanation of the process leading to the improved filterability can be that the calcium carbonate formed during the reaction between the calcium oxide (the caustic lime) and the sodium carbonate in the green liquor constitutes particles or particle aggregates with such properties that they can easily be filtered without clogging the filter and that the fine particles in the green liquor are captured by the calcium carbonate particles, partly by occlusion in the particle aggregates as they are formed and partly on the filter.

Our own trials to use lime sludge as a filter aid by addition direct in the green liquor gave positive results but were not as effective as the procedure according to the invention. In addition the effect of use of lime sludge is quite variable, for one reason because the filtration properties of the sludge deteriorate each time the sludge is treated in pumps or agitators.

BRIEF DESCRIPTION OF THE DRAWING

The drawing is a schematic diagram of apparatus for carrying out the invention.

BEST AND VARIOUS MODES FOR CARRYING OUT INVENTION

The invention is described in the attached FIGURE for the case when the settling in green liquor clarifier has been replaced by filtering.

The smelt from the soda recovery boiler flows through smelt spouts (1) down to a tank (2) in which the smelt is mixed by means of agitators (3) with weak liquor coming through the pipe (4).

In the conventional process the resulting green liquor is pumped through the pipe (5) to the green liquor clarifier (6). From the clarifier (6) the dregs goes through the pipe (7) out for dumping, while the clarified green liquor is pumped through the pipe (8) to the lime slaker (9).

The process according to the invention includes two alternatives, 1 and 2.

By the alternative 1 caustic lime is added through the pipe (10) to the soda dissolving tank (2). The green liquor is pumped from the tank (2) through the pipe (11) to a mixing tank (13) provided with an agitator device (14) and further through the pipe (15) to the filter (16). The green liquor that has been clarified by filtering on the filter (16) is pumped through the pipe (17) to the lime slaker (9). The sludge separated on the filter (16) goes through the pipe (18) out for dumping.

By the alternative 2 caustic lime is added through the pipe (12) directly to the mixing tank (13) at the same time as green liquor from the soda dissolving tank (2) through the pipe (11) is brought to the mixing tank (13). The mixture is, as by alternative 1, pumped further through the pipe (15) to the filter (16) and the clarified green liquor from the filter (16) is pumped to the lime slaker (9). The sludge separated on the filter (16) goes through the pipe (18) out for dumping.

The following treatment is identical for the conventional process and the two alternatives of the invention. To the lime slaker (9) caustic lime is brought through the pipe (19). From the lime slaker (9), where the grit is removed (28), the mixture of lime and green liquor goes to the causticizer (20) in which the reaction, the causticizing is completed. The liquor-lime sludge mixture formed is filtered on the press filter (21), from which the filtrate, the white liquor, is pumped through the pipe (22) to the digester house and the solid material separated on the filter, the lime sludge, is pumped through the pipe (23) to the lime sludge storage tank (24). From there the lime sludge is brought to the washing filter (25) for washing with hot water (26). The lime sludge (calcium carbonate) goes further to the lime kiln (27) where it is burnt to give caustic lime (calcium oxide). The lime is brought through the pipe (19) with alternative drawing off through the pipes (10), (12) and (28) to the lime slaker (9). By the conventional process inert compounds are drawn off through the pipe (28). By both the alternatives of the invention most of the drawing off of inert compounds is made from the filter (16) through the pipe (18), which is made possible by the fact that the supplying of caustic lime to the green liquor (according to alternative 1 through the pipe (10) and according to alternative 2 through the pipe (12) is adjusted to correspond to the necessary drawing off of inert compounds.

To meet the losses of lime through the drawing off, caustic lime (from another source than the lime sludge reburning in the lime kiln (27)) through the pipe (29). Alternatively, to meet these losses, the lime kiln (27) can be charged with limestone or with lime sludge from a store from the time before the use of reburning of lime sludge.

The method according to the invention has been tested by a full scale industrial trial.

For the filtering a press filter was used with the trade mark Clarifil and supplied by AB Hedemora Verkstäder, Sweden. This filter contains a large number of filter elements composed of perforated tubes with a diameter of 50 mm and the length 1,200 mm on each of which is placed a filter sock made of needled, heat treated polypropylene. The filter elements are placed in a container as is approximately outlined in (16) in the FIGURE.

The pressure drop through the filter was about 20–60 kPa. The temperature of the green liquor was 95°–100° C. At the beginning of the experiment 70 $m^3$ liquor per hour was filtered, which is 10% above the nominal capacity of the filter.

The advantages of using the invention are demonstrated in the following examples.

EXAMPLE 1

Three procedures were compared a. direct filtration of normal, unclarified green liquor
b. continuous adding of 3.5 kg lime mud per $m^3$ liquor to the liquor in the soda dissolving tank (2) and filtering of the so treated green liquor
c. continuous adding of 2.5 kg caustic lime per $m^3$ liquor through the pipe (10) to the liquor in the soda dissolving tank (2) and then filtering the outgoing green liquor, which is the method according to the invention.

The following results were obtained when filtering with for all the trials the same and during the filtering unchanged pressure drop over the filter.

| Procedure | Production at the beginning | Production before cleaning of the filter | Running time from start to stop for cleaning |
|---|---|---|---|
| a. | 70 $m^3$/h | 24 $m^3$/h | 2 days |
| b. | 70 $m^3$/h | 47 $m^3$/h | 1 week |
| c. | 70 $m^3$/h | 70 $m^3$/h | 3 weeks |

The cleaning effect of the filtration was the same in all the three cases, with less than 10 mg/l solid impurities in the filtered liquor.

By clarifying in conventional green liquor clarifiers of green liquor to which have not been added lime mud or caustic lime, the content of remaining solid impurities in the liquor normally is not less than 50 mg/l.

EXAMPLE 2

The decrease in the degree of reduction during the causticizing process when using conventionally clarified green liquor, procedure d, is compared below with the one obtained when using green liquor that is cleaned according to the invention by adding caustic lime and filtration, procedure e.

| Procedure | Degree of reduction of the smelt % | Degree of reduction of the white liquor % |
|---|---|---|
| d. | 95 | 75 |
| e. | 95 | 83 |

Such a large improvement of the degree of reduction, as this experiment shows, implies a very large economic gain.

I claim:

1. Method of clarifying green liquor in a causticizing process by removing solid particles out of unclarified green liquor prior to subsequent complete causticizing of clarified green liquor by adding caustic lime to the clarified liquor, comprising adding caustic lime to the unclarified green liquor during agitation prior to said removing of the solid particles, said caustic lime added to the unclarified liquor being in an amount of 0.5–10% of the caustic lime added for said subsequent complete causticizing.

2. Method according to claim 1, wherein said amount of caustic lime added to the unclarified green liquor is 1–3% of the caustic lime added for said subsequent causticizing.

3. Method according to claim 2, wherein the solid particles are removed by settling in a green liquor clarifier.

4. Method according to claim 2, wherein the solid particles are removed by filtration.

5. Method according to claim 1, wherein said caustic lime added to the unclarified green liquor is received from the causticizing process.

6. Method according to claim 1, wherein the solid particles are removed by settling in green liquor clarifier.

7. Method according to claim 1, wherein the solid particles are removed by filtration.

8. Method according to claim 1, wherein said amount of caustic lime added to the unclarified green liquor is 2.5–7.5 kg per metric ton pulp.

* * * * *